US005375484A

United States Patent [19]

Castelletti

[11] Patent Number: 5,375,484

[45] Date of Patent: Dec. 27, 1994

[54] VALVE PACKING REMOVAL TOOL

[75] Inventor: Robert M. Castelletti, Martins Creek, Pa.

[73] Assignee: Flanders Tool Company Inc., Flanders, N.J. ; a part interest

[21] Appl. No.: 202,764

[22] Filed: Feb. 28, 1994

[51] Int. Cl.[5] ..... B25B 33/00

[52] U.S. Cl. ..... 81/8.1; 29/235

[58] Field of Search ..... 29/235, 426.5, 426.6, 29/426.1, 234, 270; 81/8.1

[56] References Cited

U.S. PATENT DOCUMENTS 4,611,510 9/1986 Morton ..... 81/8.1
4,944,081 7/1990 Ross ..... 29/235
5,075,945 12/1991 Krzecki ..... 29/235

*Primary Examiner*—Robert C. Watson
*Attorney, Agent, or Firm*—Dallett Hoopes

[57] ABSTRACT

A packing extracting tool comprises an annular body split into two parts in a plane passing through the axis of the body so that the body can be taken apart and reassembled about a valve stem. Clamping screws hold the two parts of the body together and additional screws clamp the body onto the stem of a valve being operated on. A leg extends away from one of the body parts and terminates at its distal end in a foot having a sharp blade angled downward away from the annular body. In one version the leg may be releasably secured in a dovetail-shaped connection in the body so that the blade may be adjustably spaced from the body and may, if desired, "free wheel" downward in the dovetail-shaped connection.

13 Claims, 2 Drawing Sheets

VALVE PACKING REMOVAL TOOL

BACKGROUND OF THE INVENTION

1. Field of the Invention

This invention relates to a valve packing removal tool. More specifically, the invention relates to a packing removal tool in which the downward and rotary movement of the valve stem is used to propel downward and rotate the removal blade.

2. Description of Related Art

In the prior art there are examples of packing extractors. One is shown in the U.S. Pat. No. 3,651,717 to W. P. Johnston, Jr. In this arrangement a split ring is held on the valve stem by a split nut. The ring, free to rotate, is engageable by a spanner wrench and has a downward helix, winding about the valve stem and ending in an extractor point. In operation, the Johnston tool is installed on the valve stem or pump shaft so that the point touches the packing to be extracted. As the ring is turned by the spanner, the point digs into the packing and extracts it.

Other art includes U.S. Pat. No. 4,611,510 to Morton in which a hinged cylindrical tool can be installed on the pipe and is provided with a turning rod, the cylindrical tool having forwardly projected piercing edges which dig into the packing as the cylindrical body is turned.

U.S. Pat. No. 2,822,713 to Schmidt discloses a core tool which slips over a valve stem and may be turned to remove the packing as the points dig in.

U.S. Pat. No. 1,635,743 to Davenport shows a hinged structure which may encircle a piston rod and may be turned to dig into the packing and may be pulled up by a lever.

U.S. Pat. No. 4,509,392 to Smith shows a spreader-type tool which may have its jaws inserted between the packing and the projection and spread to force the cutter into the packing to remove it.

The above art relies on brute force of the operator to lower the actual extractor blade, and there is no means for precisely controlling the travel of the extractor blade. It is an object of the present invention to use the valve stem adjacent the packing as the means by which the extractor blade is driven downward. Hence, during the downward movement there is no need for additional wrenches, rods, or other means to rotate the extractor.

In a preferred embodiment, while the rotary movement may be provided by the valve stem itself, the blade is permitted to "free-wheel" and move down into the packing tool at a rate depending partly on the blade angle. Once the blade arrives at the floor of the packing chamber, the "free-wheeling" assures that no scoring of the floor will occur.

SUMMARY OF THE INVENTION

The invention is a packing extracting tool comprising an annular body split into two parts in a plane passing through the axis of the body and bolted together so that the body can be taken apart and reassembled about a valve stem. The invention also includes clamping screws for clamping the body onto the stem of a valve containing the packing. The invention further includes a leg extending away from one of the annular body halves and terminating at its distal end in a sharp blade angled downward away from the body. In one version the leg may be releasably secured in a dovetail shaped connection in its body half so that the blade may be adjustably spaced from the body and may, if desired, "free-wheel" downward in the dovetail connection.

An object of the invention is to have an extractor tool which may be clamped onto the valve stem and may be driven into the packing as the valve handle is turned toward closed position, peeling off packing as it goes. In the "free-wheeling" version the blade is drawn down depending primarily on the angle of the blade. When the blade is permitted to "free-wheel", it rides down until all of the packing material is removed and then will stop, circling harmlessly around the floor of the packing chamber.

BRIEF DESCRIPTION OF THE DRAWINGS

Further objects and features of the invention will be clear to those skilled in the art upon reading the following specification and referring to the drawings appended thereto. In the drawings.

DESCRIPTION OF THE PREFERRED EMBODIMENT

Figure 3:
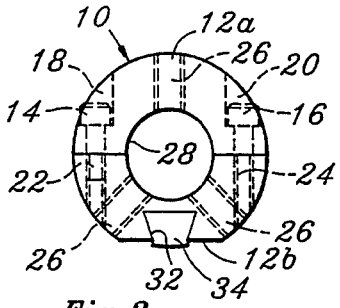
FIG. 3 is a top plan view.
Figure 1:
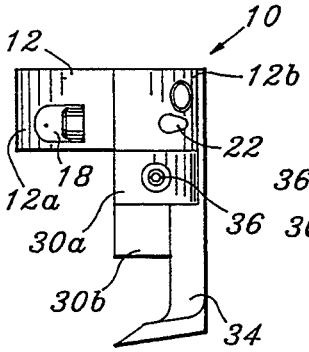
FIG. 1 is a front elevation of a preferred form of the invention.

A packing extractor embodying the invention is generally designated 10 in FIG. 1. It comprises a body defined by a split ring 12 having semi-cylindrical parts 12*a* and 12*b*. FIG. 3 shows the extractor from above and shows the two halves 12*a* and 12*b* secured together into donut shape by bolts 14, 16 extending from respective recesses 18, 20 on part 12*a* through appropriate bores and into tapped openings 22, 24 in the part 12*b*.

Radial clamping screws 26 are disposed about the body of the extractor body and are directed inward through appropriate tapped radial openings to the central opening 28. The purpose of the screws 26 is to clamp the body of the extractor fixedly onto the valve stem S of valve V from which the packing P is to be extracted. The stem (FIG. 4) is shown to have the usual righthand thread which cooperates with the threaded opening 0 in the body of the valve V so that when the handle H is turned, the valve stem descends into the valve body and its gate (not shown) closes off the valve.

As shown in FIG. 1, the part 12*b* is formed with a downward stepped boss 30 having preferably two steps 30*a* and 30*b*, the latter being thicker than the former. The stepped boss is arcuate in general shape reflecting the shape of part 12*b*. The side face 12*c* of the main part 12*b* is milled off so that it is flush with the curve of the outer face of the stepped boss 30*a*, 30*b*.

Figure 2:
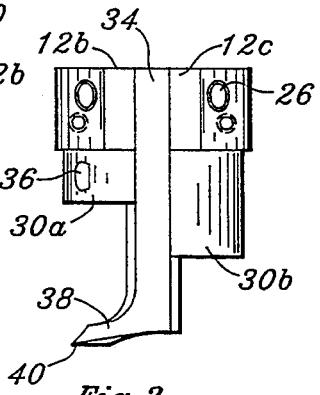
FIG. 2 is a side elevation.
Figure 4:
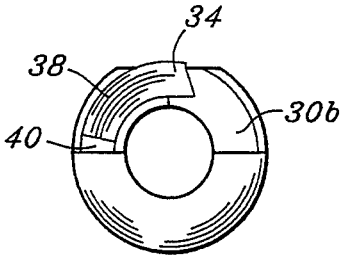
FIG. 4 is a bottom plan view.

A dovetail-shaped slot 32 is formed in part 12*b* and runs parallel to the axis of the annular body defined by parts 12*a*, 12*b*. The slot 32 receives the dovetail-shaped leg 34 (FIG. 2). The leg 34 is slideable in the slot 32 but may be fixed in position by a set screw 36 preferably extending through the smaller step 30*a* of the boss 30*a*, 30*b*. The lower end of the leg 34 is formed with a foot 38 on the toe of which is a sharpened cutting blade 40 (FIG. 4).

Figure 5:
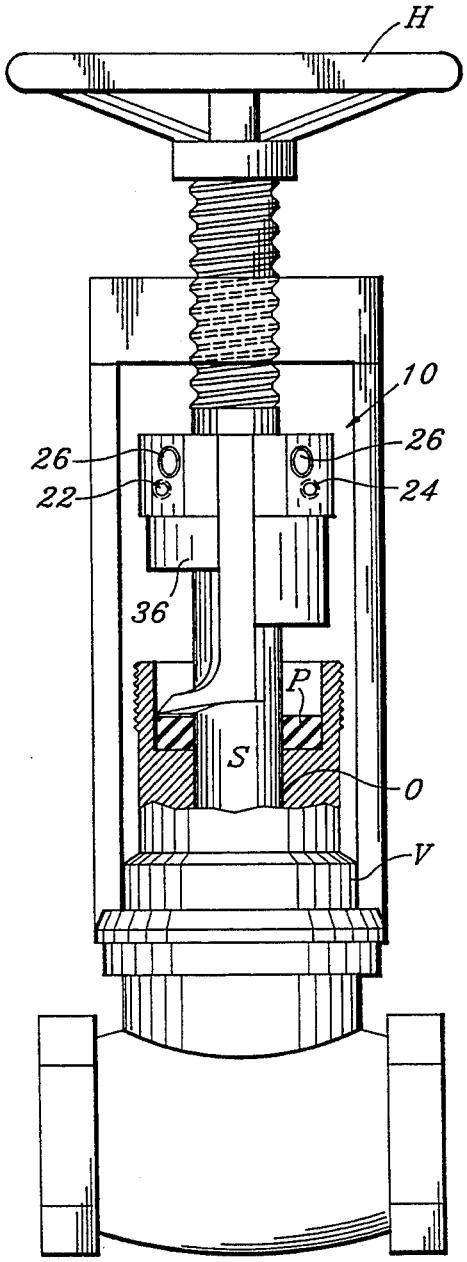
FIG. 5 is a side elevation showing the packing remover of the invention installed on the valve stem of a gate valve from which packing is to be extracted.
Figure 7:
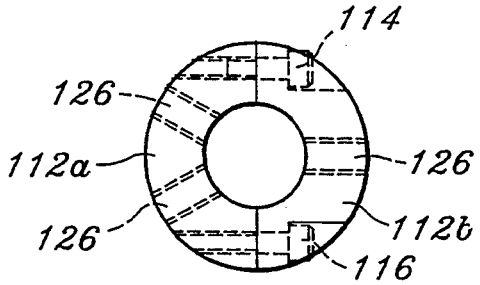
FIG. 7 is a top plan view of the FIG. 6 embodiment.
Figure 8:
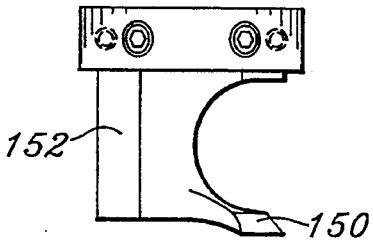
FIG. 8 is a front elevation.
Figure 6:
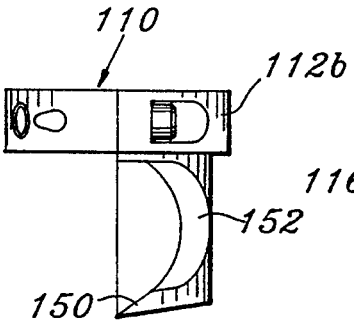
FIG. 6 is a side elevation of another embodiment of the invention.
Figure 9:
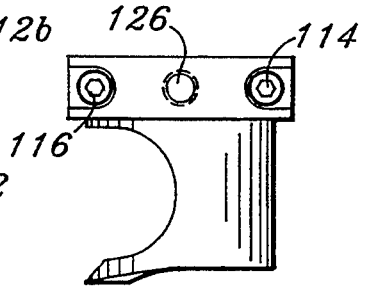
FIG. 9 is a rear elevation.
Figure 10:
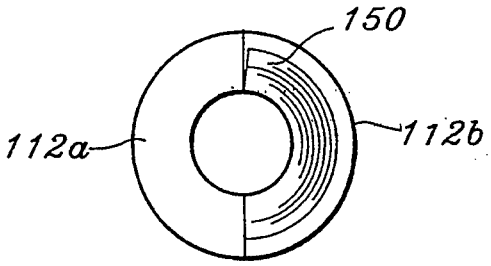
FIG. 10 is a bottom plan view.

In operation, the embodiment disclosed in FIGS. 1 through 4 is secured on the valve stem S of a valve V by disassembling the two parts 12*a*, 12*b*, that is, removing the bolts 14, 16 and reassembling the parts with the body opening 28 hugging the stem S. Thereafter, the screws 26 which may be set screws having Allen-type heads are tightened against the valve stem S, immobilizing the extractor body thereon as shown in FIG. 5. The placement of the body on the stem S axially is where the foot 38 contacts the packing P and the valve is all the way open. Screw 36 is tightened. The valve handle H is then turned clockwise in a closing operation and as the stem progresses downwardly into the valve body B the blade 40 cuts into the packing P.

After two or three turns of the handle H, the progress may be stopped and the peeled-off packing may be picked away from the body of the packing and discarded.

During the operation thus far described, the actual cutter has been in fixed position on the body of the extractor by the set screw 36 which angles into the leg 34 holding it immobile with respect to the body comprising parts 12*a*, 12*b*. However, if desired, the blade may be liberated in its dovetail recess by backing off on the set screw 36. Then, as the valve handle is turned, automatically the blade 40 will core out the remainder of the packing descending into it depending on the angle of the blade with respect to radial. In other words, the blade angle may drive the blade downward in the packing faster than the body actually descends. This, of course, depends on the pitch of the valve stem thread. When the edge reaches the metal bottom of the packing cavity, the blade will telescope into the dovetail slot 32 as turning the valve clockwise continues because the edge 40 has nothing to dig into.

The "free-wheeling" discussed assures prompt removing of the packing and, at the same time, assures that even when the blade 40 touches the bottom of the packing chamber, it will ride harmlessly on the floor and not score it.

DESCRIPTION OF THE MODIFIED EMBODIMENT

FIGS. 6 through 9 disclose an embodiment different from the FIGS. 1 through 4 embodiment in that the blade 150 and the leg 152 are fixed to the body of the extractor 110. In drawings of this embodiment the same parts are designated by the same number as in the earlier embodiment, adding 100.

Thus, the parts 12*b* and 12*a* are secured together by bolts 114 and 116 and the clamping bolts 126 anchor the annular body to the valve stems in use. The blade 150 and leg 152 are unitary and integral with the part 112*b* and extend down therefrom with the blade 150 in fixed position.

The operation of the modified form is thus similar to the operation of the preferred form except there is no "free-wheeling" or adjustability of the blade with respect to the body. As with the earlier embodiment, the FIGS. 6 through 10 embodiment in use is secured to the stem when the valve is fully open and with the blade 150 resting on the packing P. The handle H is turned downward and the blade 150 cuts into the packing, extracting it as before.

It should be understood that prior to the operation of either embodiment, the packing nut (not shown) has been removed from the valve and raised on the stem above the extractor unit. Once the packing material is installed, the nut may be brought down and tightened as is conventional.

It should be understood that the invention is not limited to the embodiments shown, but the invention is instead defined by the scope of the following claim language, expanded by an extension of the right to exclude as is appropriate under the doctrine of equivalents.

What is claimed is:

1. A packing extraction tool comprising:

a. an annular body being split into two parts in a plane passing through its axis so that it can be taken apart and reassembled about a valve stem, the body being formed with at least one radial tapped bore, b. clamping means for holding the two parts of the annular body together circumposing a valve stem, c. means immobilizing the annular body on the valve stem comprising a set screw received into the radial tapped bore, and d. a leg attached to one of the parts and extending in a direction parallel to the axis away from the body and terminating at its distal end in a foot having a sharp blade angled away from the body, whereby when the body is assembled and immobilized on the stem and the valve stem is turned toward closed position, the blade traces a helical path about the axis of the stem and digs into and extracts the valve packing surrounding the stem.

2. A packing extraction tool as claimed in claim 1 wherein the leg is lengthwise adjustable and fixable relative to the said one part.

3. A packing extraction tool as claimed in claim 2 wherein said one part comprises a boss integral therewith said one part having an opening therein parallel to the axis and said leg is fixedly adjustable lengthwise in the opening and means for fixing the position of the leg in the opening.

4. A packing extraction tool as claimed in claim 3 wherein the means fixing the position of the leg in the boss comprises a set screw.

5. A packing extraction tool as claimed in claim 4 wherein the opening in the boss is non-circular and the cross-section of the leg complements the non-circular shape.

6. A packing extraction tool as claimed in claim 5 wherein the opening is an undercut slot and the leg is of similar shape in cross-section.

7. A packing extraction tool comprising:

a. an annular body being split into two parts in a plane passing through its axis so that it can be taken apart and reassembled about a valve stem, one of the parts comprising a boss integral therewith said one part having a dovetail-shaped slot therein parallel to the axis, b. clamping means for holding the two parts of the annular body together circumposing a valve stem, c. means immobilizing the annular body on the valve stem, and d. a leg having a complementary dovetail shape fixedly adjustable lengthwise in the slot and set screw means for fixing the position of the leg in the slot, the leg extending in a direction parallel to the axis away from the body and terminating at its distal end in a foot having a sharp blade angled away from the body, whereby when the body is assembled and immobilized on the stem and the valve is turned toward closed position, the blade traces a helical path about the axis of the stem and digs into and extracts the valve packing surrounding the stem.

8. In combination:

a. a valve having a valve body, a stem bore in the body and a threaded stem in the bore surrounded in the body by packing and adapted on being turned to move farther into the body to close the valve, and b. a packing extraction tool comprising:

1. an annular body being split into parts in a plane passing through its axis so that it can be taken apart and reassembled about the valve stem,
2. means holding the parts of the annular body together circumposing the valve stem and immobilizing the annular body on the valve stem, and
3. a leg attached to one of the parts and extending in a direction parallel to the axis away from the body and terminating at its distal end in a foot having a sharp blade angled away from the body, whereby when the valve stem is turned toward closed position, the blade traces a helical path about the axis of the stem and digs into and extracts the valve packing surrounding the stem.

9. A combination as claimed in claim 8 wherein the body is formed with radial tapped bores which receive set screws to comprise the means for immobilizing the body to the valve stem.

10. A combination as claimed in claim 8 wherein said one part comprises a boss integral therewith said one part having an opening therein parallel to the axis and said leg is fixedly adjustable lengthwise in the opening and means for fixing the position of the leg in the opening.

11. A combination as claimed in claim 10 wherein the means fixing the position of the leg in the boss comprises a set screw.

12. A combination as claimed in claim 11 wherein the opening in the boss is non-circular and the cross-section of the leg complements the non-circular shape.

13. A combination as claimed in claim 12 wherein the opening is an undercut slot and the leg is of similar shape in cross-section.

* * * * *